US006224523B1

(12) United States Patent
Peng

(10) Patent No.: US 6,224,523 B1
(45) Date of Patent: May 1, 2001

(54) CORD CONTROLLER OF EXERCISE DEVICE

(76) Inventor: Hsin-Hsing Peng, No. 43, Tung An Street, Feng Yuan City, Taichung Hsien (TW)

( * ) Notice: Subject to any disclaimer, the term of this patent is extended or adjusted under 35 U.S.C. 154(b) by 0 days.

(21) Appl. No.: 09/249,770

(22) Filed: Feb. 16, 1999

(51) Int. Cl.[7] ..... A63B 61/00; A63B 69/00
(52) U.S. Cl. ..... 482/127; 473/425; 273/330
(58) Field of Search ..... 473/108, 110, 473/128, 138, 142, 416, 415, 425, 424, 229, 431, 436, 524, 553; 482/127; 27/317.4, 330

(56) References Cited

U.S. PATENT DOCUMENTS 2,128,610 * 8/1938 Heimers ..... 473/425
2,945,695 * 7/1960 Heimers et al. ..... 473/425
4,129,110 * 12/1978 Kubrak ..... 124/16
5,649,699 * 7/1997 Todoroff .
5,816,928 * 10/1998 Colonna ..... 473/229

* cited by examiner

*Primary Examiner*—Mickey Yu
*Assistant Examiner*—Victor Hwang
(74) *Attorney, Agent, or Firm*—Browdy and Neimark

(57) ABSTRACT

A cord controlling device is used in conjunction with a game racket and is composed essentially of a housing formed of a base and an upper cover. The base is provided with a fastening portion by which the device is fastened with the head frame network of the game racket. The base is provided at the center of the upper side thereof with a shaft on which a rotary seat is rotatably mounted. The rotary seat is provided with a receiving chamber in which a volute spring is located such that the volute spring is fastened at one end thereof with the rotary, seat, and at other end thereof with the shaft of the base. A cord reel is mounted on the rotary seat for winding up or letting out a cord which is wound on the cord reel such that the cord is fastened at one end thereof with the cord reel, and that other end of the cord is let out via a cord outlet of the housing for fastening with a ball.

13 Claims, 3 Drawing Sheets

CORD CONTROLLER OF EXERCISE DEVICE

FIELD OF THE INVENTION

The present invention relates generally to an exercise device, and more particularly to a cord controller that is fastened with a game racket having an oval or round frame of network of catgut, silk, nylon, etc. The cord is fastened at one end thereof with a ball, which can be retrieved by the cord after the ball is hit by the game racket.

BACKGROUND OF THE INVENTION

Certain ball games, such as badminton and tennis, are played by at least two persons using the rackets to hit the ball or shuttlecock back and forth in a court. In other words, it is impossible for a person to play the ball games described above.

There is a conventional wooden game racket to which an elastic cord is attached such that the free end of the elastic cord is fastened with a ball which can be retrieved by the elastic cord after the ball is hit by the racket. The racket is not provided with a means for adjusting the length of the elastic cord in accordance with the body size or the training need of a player. The excessive length of the elastic cord is shortened by winding the cord around the racket. Such a primitive way of adjusting the length of the elastic cord makes it difficult for the player to hit the ball with precision.

SUMMARY OF THE INVENTION

It is therefore the primary objective of the present invention to provide a cord controlling device which is fastened with a game racket for retrieving a ball that is fastened with the free end of the cord. The cord can be easily adjusted in length by the device which can be detachably fastened with the game racket by a player.

The cord controlling device of the present invention comprises a housing which is composed of an upper cover and a base. The base is provided with a fastening portion by which the device is fastened with the frame of a game racket. The base is provided at the center of the upper side thereof with a shaft on which a rotary seat is rotatably mounted. The rotary seat is provided with a receiving space in which a volute spring is located such that one end of the volute spring is fastened with the rotary seat and that other end of the volute spring is fastened with the shaft. A cord reel is mounted on the rotary seat for winding up or letting out a cord which is wound on the cord reel such that the cord is fastened at one end thereof with the cord reel and that other end thereof is let out via a cord outlet of the housing for fastening with a ball.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
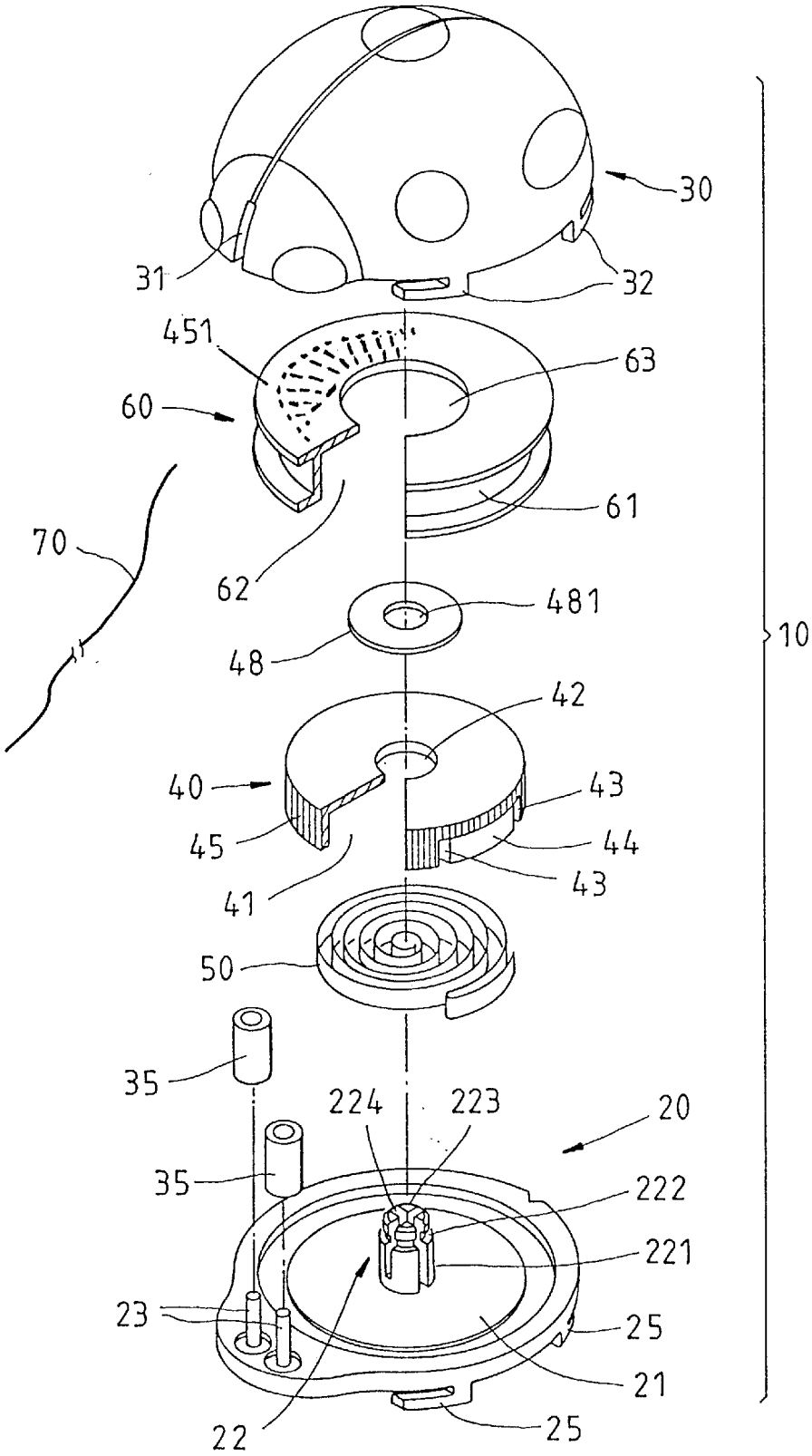
FIG. 1 shows an exploded view of the preferred embodiment of the present invention.
Figure 2:
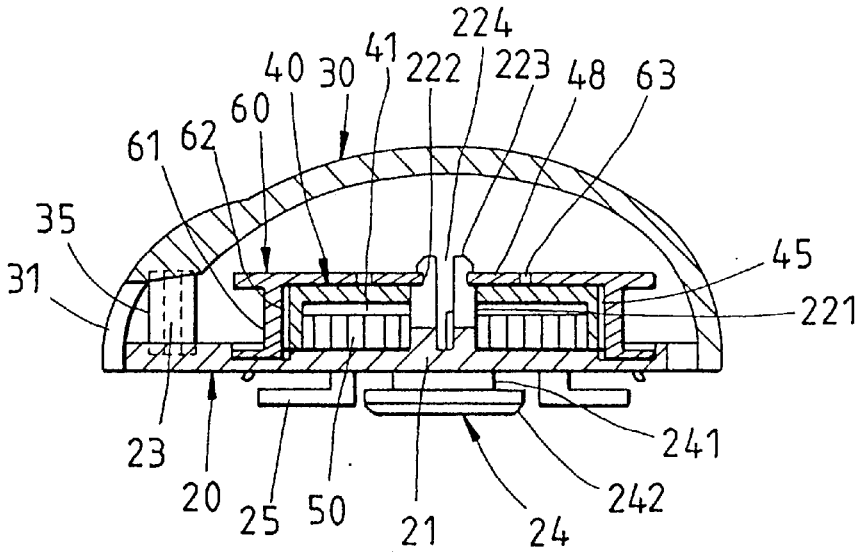
FIG. 2 shows a sectional view of the preferred embodiment of the present invention in combination.

As shown in FIGS. 1 and 2, a cord controlling device embodied in the present invention comprises the component parts which are described hereinafter.

A housing 10 is formed of a base 20 and an upper cover 30.

The base 20 has a disk body 21 which is provided in the upper side thereof with a shaft 22 which is in turn provided with a body portion 221, a neck portion 222, and a head portion 223. The neck portion 222 is smaller in outer diameter than the body portion 221 and the head portion 223. The shaft 22 is further provided with a cruciform slit 224. The disk body 21 is provided at the front end of the top thereof with two fitting rods 23. Now referring to FIG. 3, the disk body 21 is provided in the underside thereof with a main fastening portion 24 which is formed of a square flat block 241 connected with the underside of the disk body 21, and a round disk 242 connected with the bottom side of the square flat block 241. The square flat block 241 has a size which is about equal to the size of one mesh (R) of the head frame network of a game racket. The disk body 21 is provided in the periphery of the underside thereof with four fastening portions 25 of a hooked construction, with two fastening portions 25 being located side by side in the front side, and with other two fastening portions 25 being located side by side in the rear side. The two fastening portions 25 located in the front side and the other two fastening portions 25 located in the rear side are hooked in opposite directions.

The upper cover 30 is of a semi-spherical construction and is provided in the center of a front end thereof with a cord outlet 31. The upper cover 30 is further provided in the periphery thereof with four fastening portions 32 which are of a hooked construction and corresponding in location to the four fastening portions 25 of the base 20.

Figure 3:
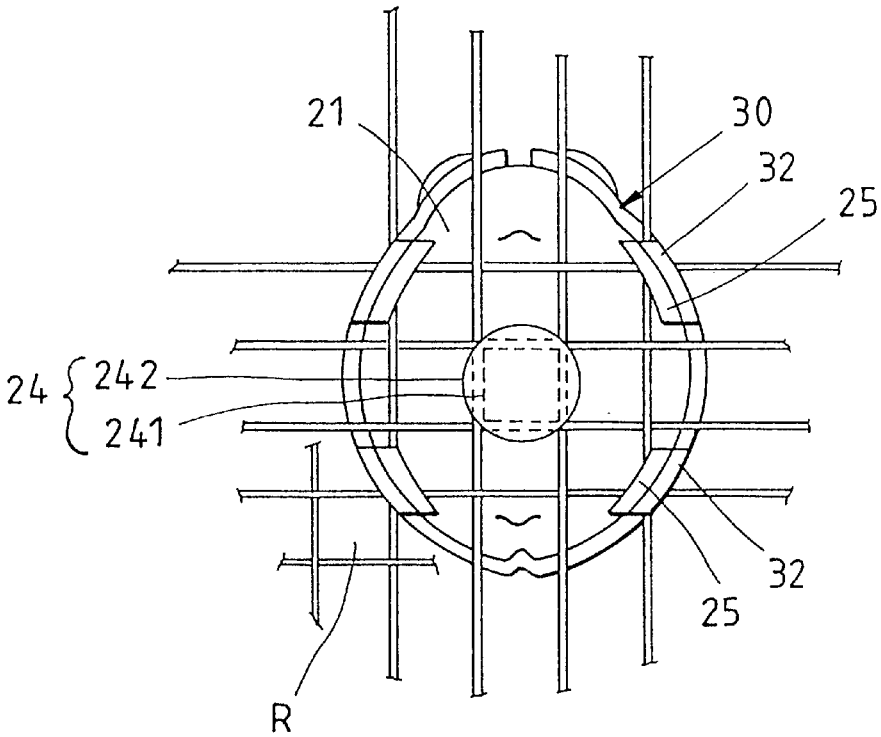
FIG. 3 shows a bottom view of the preferred embodiment of the present invention that is fastened with the head frame of a game racket.

The upper cover 30 is joined with the base 20 such that the four fastening portions 32 of the upper cover 30 are engaged with the four fastening portions 25 of the base 20, as shown in FIG. 3.

Two round tubes 35 are respectively fitted over the two fitting rods 23 such that the two round tubes 35 urge the inner sides of the upper cover 30 and the base 20, and that the two round tubes 35 are capable of turning freely. Located between the two round tubes 35 is a gap which is aligned with the cord outlet 31.

A rotary seat 40 has an axial length which is equal to the length of the body portion 221 of the shaft 22 of the base 20. The rotary seat 40 is provided with a receiving chamber 41 of a columnar construction and having an opening which faces downward, and a pivoting hole 42 extending from the center of the top thereof to the receiving chamber 41 and having a hole diameter greater than the outer diameter of the body portion 221 of the shaft 22. The rotary seat 40 is provided in the wall thereof with two insertion slits 43 and a recessed portion 44 located between the two insertion slits 43. With the exception of the recessed portion 44, the periphery and other structural portions of the rotary seat 40 are provided with a toothed portion 45. The rotary seat 40 is rotatably mounted on the shaft 22 such that the pivoting hole 42 of the rotary seat 40 is fitted over the shaft 22.

A locating piece 48 is provided with a center hole 481 having a diameter which is equal to the outer diameter of the neck portion 222 of the shaft 22 of the base 20. The locating piece 48 is fitted over the neck portion 222 of the shaft 22 for preventing the rotary seat 40 from disengaging the body portion 221 of the shaft 22.

A volute spring 50 is disposed in the receiving chamber 41 of the rotary seat 40 such that one end of the volute spring 50 is retained in the cruciform slit 224 of the shaft 22, and that other end of the volute spring 50 is folded in reverse to jut out of one of the two insertion slits 43 of the rotary seat 40 to extend along the recessed portion 44 to engage the other one of the two insertion slits 43. In other words, both ends of the volute spring 50 are respectively fastened with the shaft 22 and the rotary seat 40.

A cord reel 60 is provided with a cord receiving groove 61, a fitting hole 62 and a through hole 63. The cord reel 60 is mounted on the rotary seat 40 such that the fitting hole 62 is fitted over to separably to engage the rotary seat 40, and that the cord reel 60 is capable of turning along with the rotary seat 40. In order to enhance the friction between the cord reel 60 and the rotary seat 40 and to permit easy removal of the reel 60 from the housing for adjustment of the length of cord 70 extending out of the housing when spring 50 is compressed by winding or unwinding the cord 20 on the reel 60, the fitting hole 62 of the cord reel 60 may be provided in the hole wall thereof with a toothed portion 45 having teeth engageable with the teeth of the toothed portion 45 of the periphery of the rotary seat 40.

A tensile cord 70 is wound on the cord reel 60 such that one end of the cord 70 is fastened in the cord receiving groove 61 of the cord reel 60, and that other end of the cord 70 is put through between the two round tubes 35 to emerge from the cord outlet 32 of the housing 10, and further that other end of the cord 70 is fastened with a ball.

In operation, when the cord 70 is let out, the rotary seat 40 and the cord reel 60 turn at the same time whereas the volute spring 50 is compressed by the rotary seat 40 in motion. As the extraction of the cord 70 ceases, the rotary seat 40 and the cord reel 60 are caused to turn in reverse by the recovery force of the compressed volute spring 50. As a result, the cord 70 is wound up to retrieve the ball which is fastened with the other end of the cord 70.

Figure 4:
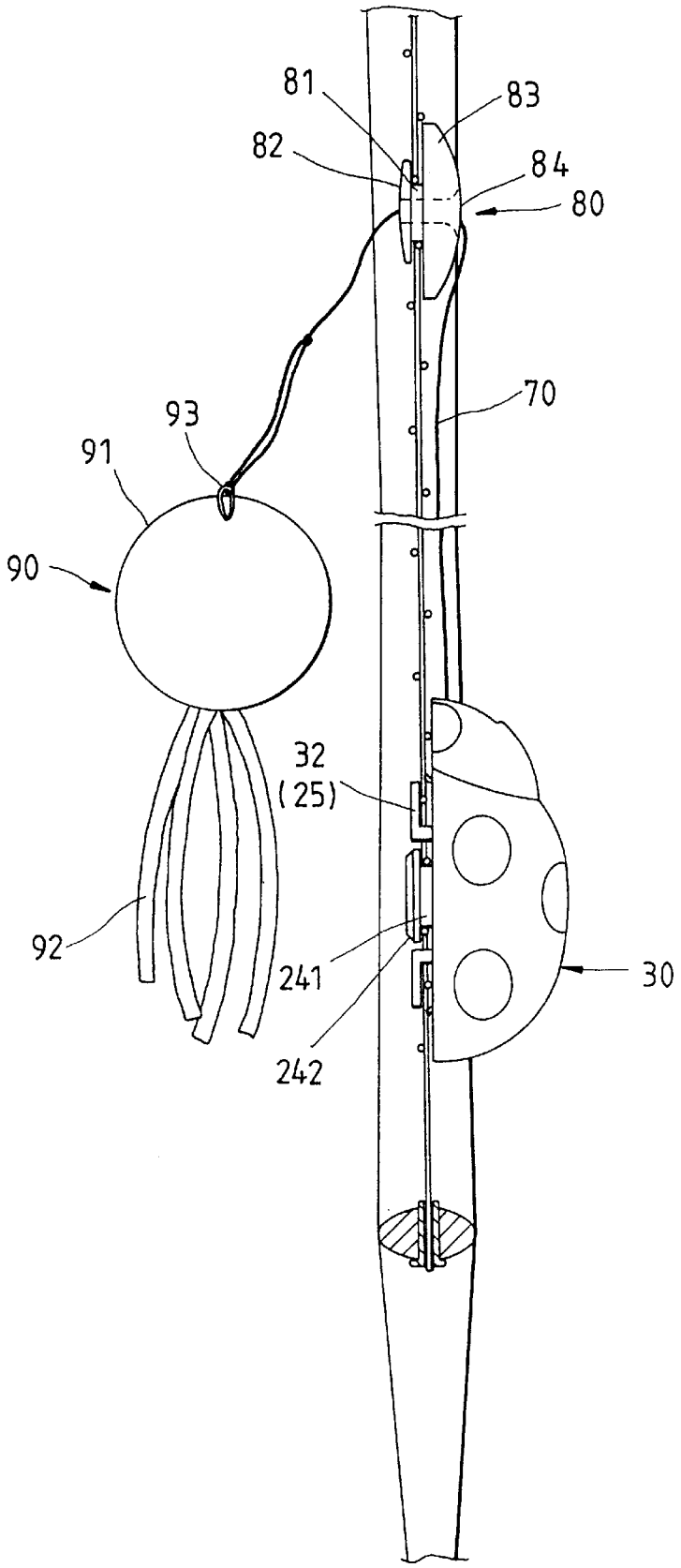
FIG. 4 shows a schematic view of the preferred embodiment of the present invention at work.

As shown in FIGS. 3 and 4, the cord controlling device of the present invention is fastened with the head frame network of a game racket such that the round disk 242 of the main fastening portion 24 is forced through one of meshes of the head frame network, and that the hooks of the fastening portions 25 and 32 catch four threads of the head frame network, further that the cord outlet 31 of the cord controlling device is located at the center of the head frame network, and further that other end of the cord 70 is put through a mesh of the upper portion of the head frame network from one side of the mesh to other side of the mesh. The upper portion of the head frame network is provided with a cord guiding member 80 which has a square flat block 81. The block 81 is fastened at both ends thereof with a small disk 82 and a large disk 83. A cord hole 84 is extended through the large disk 83, the flat block 81 and the small disk 82. The cord guiding member 80 is fastened with the head frame network such that the small disk 82 is forced through one mesh. The other end of the cord 70 emerges from the other side of the head frame network via the cord hole 84. The other end (outer end) of the cord 70 is then fastened with a game ball 90, which has an elastic round body 91. The round body 91 is provided at one end thereof with a plurality of ribbons 92, and at other end thereof with a connection ring 93 for fastening with the outer end of the cord 70. The ball 90 may be a shuttlecock and the like.

As the ball 90 is hit by the game racket, the cord 70 is extracted such that the rotary seat 40 and the cord reel 60 are caused to turn thereby resulting in the volute spring 50 to be compressed. The ball 90 is retrieved at the time when the extraction of the cord 70 ceases and at the time when the rotary seat 40 and the cord reel 60 are caused to turn in reverse by the recovery force of the compressed volute spring 50, thereby resulting in the winding up of the cord 70. The ball 90 can be hit once again.

The length of the cord portion located outside the housing 10 depends on the height and the arm length of a person using the game racket. The length can be adjusted by removing first the upper cover 30 so as to remove the cord reel 60 from the rotary seat 40, thereby enabling the person to wind up or let out an additional length of the cord 70. The cord reel 60 is then remounted on the rotary seat 40 before the upper cover 30 is once again joined with the base 20. In the event that the cord 70 must be replaced with new one due to damage or fatigue, the cord reel 60 is removed by following the steps described above so as to replenish the cord reel 60 with a new cord.

What is claimed is:

1. A cord controller for use with a game racket, said cord controller comprising:

a housing consisting of a base and an upper cover joined detachably with said base, said base provided in an upper side thereof with a shaft, said cover having a cord outlet in communication with an interior space of said cover and atmospheric air, said base having on an underside at least one fastening portion adapted to be fixed to a head frame network of the game racket;

a rotary seat provided with a receiving chamber having an opening and a pivoting hole extending from a top of said rotary seat to said receiving chamber, said rotary seat being mounted on said base by locating means such that said pivoting hole of said rotary seat is rotatably engaged to said shaft of said base;

a volute spring disposed in said receiving chamber of said rotary seat such that a first end of said volute spring is fastened with said shaft, and that a second end of said volute spring is fastened with said rotary seat;

a cord reel provided with a cord winding groove and a fitting hole which receives and engages said rotary seat, said cord reel being separably mounted on said rotary seat such that said fitting hole is fitted over said rotary seat so that said cord reel and said rotary seat rotate at the same time; and a cord wound in said cord winding groove of said cord reel such that a first end of said cord is fastened with said cord reel, and that a second end of said cord is extended into atmospheric air via said cord outlet of said housing for fastening with a ball;

wherein when a player hits the ball the volute spring is compressed to return the ball to the head frame network, and wherein said cover can be separated from the base to permit removal of the cord reel from the rotary seat to adjust a length of the cord on the cord reel while leaving the rotary seat fixed to the head frame network.

2. The cord controller as defined in claim 1, wherein said base has a disk body; wherein said shaft is extended from an upper side of said disk body.

3. The cord controller as defined in claim 2, wherein said disk body is provided in a center of an underside of the disk body with a square flat block which is equal in size to one of meshes of the head frame network of the game racket and is provided in a bottom side of the disk body fastened therewith; and wherein said fastening portion of said base is formed said round disk and the square flat block.

4. The cord controller as defined in claim 2, wherein said disk body is provided in a front periphery of an underside with two fastening portions of a hooked construction, and in a rear periphery of said underside with two fastening portions of a hooked construction, with said two fastening portions of said front periphery being hooked in one direction, and with said two fastening portions of said rear periphery being hooked in other direction which is opposite to the one direction.

5. The cord controller as defined in claim 4, wherein said upper cover is provided in a front periphery with two fastening portions of a hooked construction, and in a rear periphery with two fastening portions of a hooked construction, with said two fastening portions of said front periphery being hooked in one direction, and with said two fastening portions of said rear periphery being hooked in other direction opposite the one direction, wherein the fastening portions of the cover are respectively and separably engaged to the fastening portions of the disk body.

6. The cord controller as defined in claim 1, wherein said shaft of said base has both a body portion and, a head portion above to said base, and a neck portion located between said body portion and said head portion, said neck portion being smaller in outer diameter than said body portion and said head portion, said shaft provided with a slit, said neck portion being fitted into a locating piece; and wherein said rotary seat is fitted over said body portion of said shaft.

7. The cord controller as defined in claim 1, wherein said rotary seat is provided in a periphery of the rotary seat with two insertion slits and a recessed portion located between said two insertion slits; and wherein said volute spring has an outer end which is folded in reverse to penetrate through one of said two insertion slits to extend along said recessed portion such that said outer end is retained in other one of said two insertion slits.

8. The cord controller as defined in claim 1, wherein said rotary seat is provided in the periphery with a plurality of teeth.

9. The cord controller as defined in claim 8, wherein said fitting hole of said cord reel is provided in an inner wall with a plurality of teeth which are engaged with said teeth of said rotary seat.

10. The cord controller as defined in claim 2, wherein said base is provided at a top thereof with two fitting rods, and two round tubes fitted respectively over said two fitting rods; and wherein the second end of said cord is put through between said two round tubes before jutting out of said housing from said cord outlet.

11. The cord controller as defined in claim 1, wherein said cord is a tensile cord.

12. The cord controller as defined in claim 1 further comprising a cord guiding member having a cord hole, said cord guiding member adapted to be fastened with the head from network of the game racket such that said second end of said cord can be put through a mesh from one side of the mesh to another side of the mesh via said cord hole of said guiding member.

13. The cord controller as defined in claim 12, wherein said cord guiding member has a square flat block which is provided at both sides with a disk fastened therewith; and wherein said cord hole is extended through said disks fastened with both sides of said square flat block.

* * * * *